United States Patent [19]

Lonati

[11] Patent Number: 4,580,420

[45] Date of Patent: Apr. 8, 1986

[54] SELECTION DEVICE FOR A CIRCULAR KNITTING MACHINE

[75] Inventor: Francesco Lonati, Brescia, Italy

[73] Assignee: Lonati S.p.A., Brescia, Italy

[21] Appl. No.: 438,135

[22] Filed: Nov. 1, 1982

[30] Foreign Application Priority Data

Nov. 26, 1981 [IT] Italy ..... 23632/81[U]

[51] Int. Cl.[4] ..... D04B 15/74

[52] U.S. Cl. ..... 66/227; 66/239

[58] Field of Search ..... 66/25, 42 R, 224, 225, 66/227, 239, 240, 241

[56] References Cited

U.S. PATENT DOCUMENTS

| | | | |
|---|---|---|---|
| 3,184,929 | 5/1965 | Reymes-Cole | 66/227 |
| 3,864,941 | 2/1975 | Kuhn | 66/224 X |
| 4,226,096 | 10/1980 | Lonati | 66/224 |
| 4,369,637 | 1/1983 | Micheletti | 66/239 X |

FOREIGN PATENT DOCUMENTS

| | | | |
|---|---|---|---|
| 2753833 | 8/1978 | Fed. Rep. of Germany | 66/225 |
| 1341571 | 9/1963 | France | 66/224 |

*Primary Examiner*—Wm. Carter Reynolds

*Attorney, Agent, or Firm*—Guido Modiano; Albert Josif

[57] ABSTRACT

For controlling selection of needles, intermediate jacks or pattern jacks in a circular knitting machine there is provided a stepwise advanced pattern drum selectively acting on selection slides which interfere with butts of needles, intermediate jacks or pattern jacks. The drum is advanced by a pawl pivoted to a rocking lever controlled by a cam profile the axis whereof is different from the axis of the needle cylinder. The cam is rotated at a speed timed to that of the needle cylinder. The cam has two different profiles at different heights for acting on the lever and may be provided with additional superposed profiles for direct action on the selection slides.

1 Claim, 2 Drawing Figures

SELECTION DEVICE FOR A CIRCULAR KNITTING MACHINE

BACKGROUND OF THE INVENTION

This invention relates to a device for controlling the selection of needles, intermediate jacks, or selecting jacks, in a circular knitting machine, in particular a hose knitting machine.

It is known that that selection is generally effected by means of slides arranged in banks or packages and selectively movable in their length direction to engage or not to engage butts of selecting jacks, or intermediate jacks, or needles. The selective movement of the slides is derived from a pattern drum provided with pegs or teeth on its lateral surface in accordance with a knitting program and being moved forward stepwise by means of a ratchet mechanism which engages with a peripheral serration on the drum periphery.

Also known is that in general the drum forward movement must be of one or two steps at a time, which complicates the construction of the drive device.

A device of the type outlined above, which selectively allows a one or two-step forward movement, is described in my U.S. Pat. No. 4,226,096.

In that device, the drive for the pattern drum forward movement ratchet pawl is derived from a ring cam rigid with the needle cylinder (or lower needle cylinder) of a circular knitting machine, the cam being formed with a special profile which includes a first portion with a gently increasing radius and second portion with a sharply increasing radius. Engaged with the cam profile is a rocking lever whereto the ratchet pawl is pivoted. Also provided is a programmed control means for disengaging the ratchet pawl from the teeth of the drum serration while the first portion of the ring cam is operative, such as to produce a single step forward movement, whereas when such disengagement means is not activated the ratchet pawl produces a two step forward movement.

Such a device has a simpler construction than prior devices and becomes operative in timed relationship with a cylinder, in either modes of forward movement. It has been found, however, that it poses some problems when it is desired that the selection capabilities be extended without substantially altering the construction of the device and the pattern drum with its related program.

SUMMARY OF THE INVENTION

It is a primary object of this invention to provide a device for controlling the selection of needles, intermediate jacks, or selecting jacks, in a circular knitting machine, in particular a hose knitting machine, which device enables the forward movement of a pattern drum alternately through one or two steps, while affording extension of the selection capabilities through but minor changes to the construction and arrangement of the program on the drum.

This object is achieved according to the invention by a device for controlling the selection of needles, intermediate jacks, or selecting jacks, in a circular knitting machine, particularly a hose knitting machine, comprising a bank of selection slides selectively movable in the direction of the length thereof for engaging butts of needles, intermediate jacks, or selecting jacks, a pattern drum having pegs or teeth arranged on the lateral surface thereof in accordance with a knitting program, and a ratchet pawl for moving the drum forward through one or two steps at a time, said ratchet pawl engaging with a peripheral serration on the drum and being pivoted to a rocking lever configured to follow the profile of a rotating cam, wherein said rotating cam is arranged along a different axis from the axis of the needle cylinder(s) and is rotated at a speed timed with the needle cylinder(s) speed, said cam being further provided with at least two profiles for acting on said lever, and preferably, with additional profiles for programmedly acting on at least one portion of said slides.

Advantageously, the arrangement of the control cam for the rocking lever outside of the cylinder area not only facilitates the arrangement of several differently configured profiles for controlling the rocking lever, to achieve one or more step forward movements, as desired, with a specially simple construction, but also the optional arrangement, above said cam, of other profiles for controlling the slides or part thereof, without involving modification of the entire drum program, but just of that part which corresponds to the slides which are newly controlled by said other profiles instead of by the pattern drum. For the alternate engagement of the various profiles on the control cam, functioning to move the pattern drum forward, a roller or the like may be provided for arrangement on the rocking lever at two or more heights such as to engage with a respective one of said profiles. The latter may have, for example, two and four lobes, respectively, to produce, when considering the cam rotational speed with respect to that of the cylinder, a one step or two step forward movement at each revolution of the cylinder.

BRIEF DESCRIPTION OF THE DRAWINGS

Further features and advantages of the invention will be more clearly apparent from the following detailed description of a preferred embodiment thereof, to be taken in conjunction with the accompanying drawings, where.

DESCRIPTION OF A PREFERRED EMBODIMENT

Figure 1:
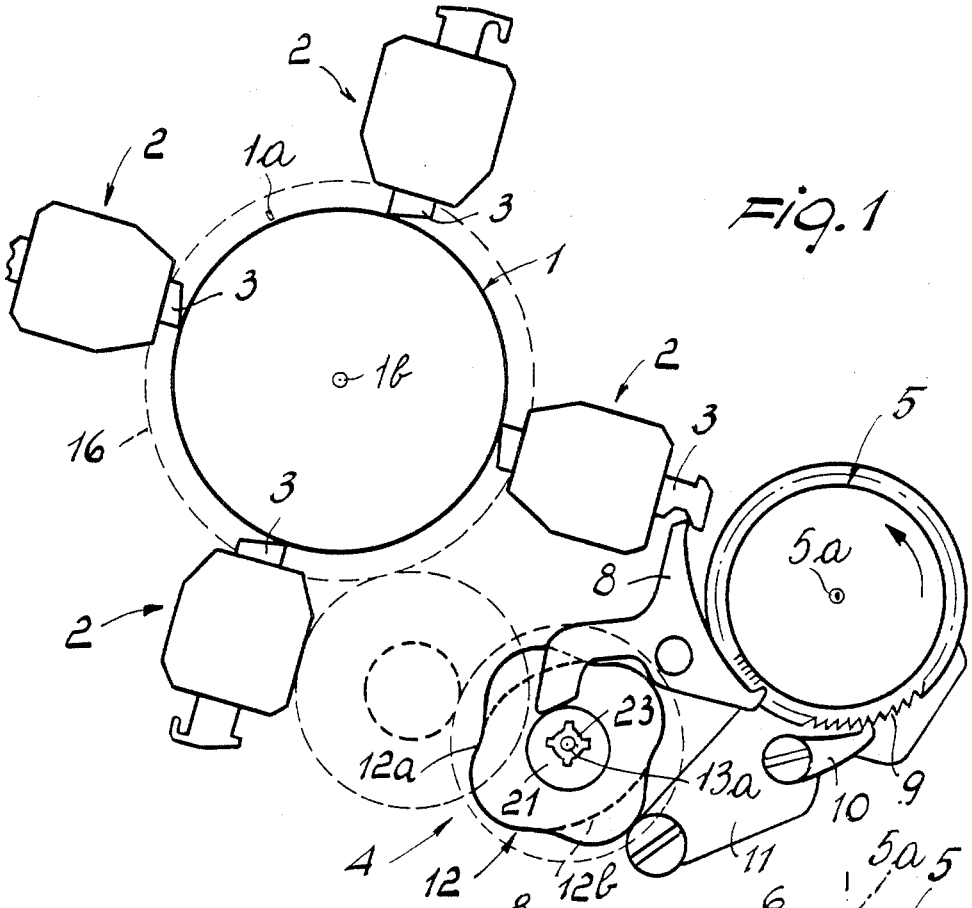
FIG. 1 is a schematical plan view of a device according to the invention in a four-feed circular knitting machine.

In the drawing figures, the reference numeral 1 designates a needle cylinder with an axis of rotation 1*b*, only shown schematically because of a known type. Around the cylinder 1, there are arranged, for example, four banks 2 of selecting slides 3 adapted to act on butts of needles 1*a* (of which only one is shown in FIG. 1), intermediate jacks, or selecting jacks in a manner known per se, at least one of the banks 2 being controlled by a device 4 according to the invention.

The device 4 comprises a pattern drum 5 of a conventional type, which is provided with peripheral ribs or sticks 6 carrying a plurality of teeth in accordance with a knitting program, and rotatably supported on a fixed portion 7 of the machine. The teeth of the ribs 6 are engaged by one end of respective control levers 8, the other end whereof engages with a respective one of the slides 3 against the bias of springs, not shown.

For the forward movement of the drum 5, a peripheral serration 9 is provided on the lower portion of the pattern drum, wherewith a ratchet pawl 10 engages conventionally which is pivoted to a rocking lever 11, whose oscillation axis coincides with that of the drum 5.

In order to impart oscillations to the rocking lever 11 effective to move the drum 5 forward through the intermediary of the ratchet pawl 10, a control cam 12 is provided attached to a small shaft 13 which is accommodated for unrestricted rotation in a bushing 14 attached to the fixed portion 7. The stationary axis 13*a* of the cam 12 is parallel to the axes 5*a* and 1*b* of the drum 5 and the cylinder 1, respectively, but at a distance therefrom. Thereby the axis 13*a* is arranged outside the periphery of the cylinder 1 and drum 5, respectively, as clearly visible in FIG. 1. The cam is driven rotatively by a set of gear wheels 15 which derive their motion directly from the gear wheel 16, known per se, which rotates the cylinder 1. The ratio of the gear wheels 14–16 is such that the control cam 12 is driven at a rotational speed timed to that of the cylinder, e.g. a half-revolution to each full revolution of the cylinder.

The control cam 12 has at least two profiles 12*a*, 12*b*, defining lobes separated by depressions. In particular, the profile 12*a* has four lobes and the profile 12*b* has two lobes. With the profiles 12*a* and 12*b*, there may be alternately engaged a roller 17 or the like, carried on the rocking lever 11 with its axis parallel to the oscillation axis thereof, the roller 17 being arrangeable at two different heights such as to alternatively follow either the profile 12*a* or 12*b*. The roller 17, or the like, is arranged rotatably on a pivot pin 18, which can be displaced axially with respect to the rocking lever 11 against the bias of a spring 19, e.g. by means of a flexible cable control or Bowden cable 20 under control by the machine program. In this manner, in view of the rotation ratios exemplified hereinabove, a forward movement of the drum 5 alternately through one or two steps at a time is effected by simply pulling or releasing the cable 20.

Figure 2:
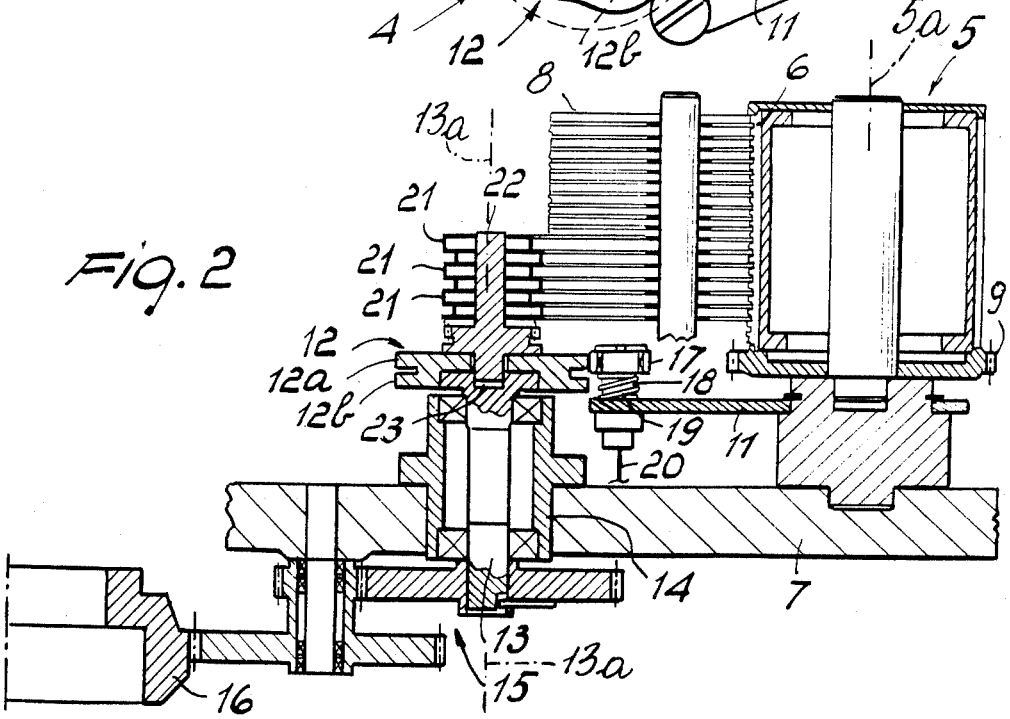
FIG. 2 shows an ideal section through the device of FIG. 1 along planes conducted through the axes of the rotary components of the device.

Advantageously, the provision of the control cam 12 outside the area of the cylinder 1 allows the arrangement above it of a plurality of superimposed selecting disks 21 attached to a supporting pin 22 which, as visible in FIG. 2, is coaxial with the axis 13*a* and is arranged at a height corresponding to the height of a portion of the vertical length of the drum 5. Said pin can be removably coupled, e.g. prismatically, with a seat 23 in the control cam 12, such as to rotate therewith. With this arrangement, at least the intermediate levers 8 located level with the selection disks 21 would have three arms, i.e. additionally to the arm in engagement with the teeth on the ribs 6 of the drum 5 and to the arm in engagement with the control end of the slides 3, they would be provided with respective arms adapted to follow the selection disks 21.

Control by the selection disks 21 may also be selective, in that the intermediate three-arm levers 8 will only follow the profile of the selection disks 21 in the event of respective arrays of teeth on the ribs 6 of the drum 5 being missing. In the case in which the tooth arrays on the ribs 6 are incomplete, it will be necessary to remove the selection disks 21, in any way.

It will be understood how, with the device described hereinabove, it becomes possible not only to easily change the drum stepwise forward movement through a constructionally very simple mechanism, but also increase the selection capabilities through the operative engagement or disengagement of additional selection disks 21 alternatively to the program of the drum 5, without any further involvement than installing on the drum 5 different ribs or sticks 6.

Advantageously, the selection disks 21 are of eccentric configuration for knitting stockings with the so-called net pattern. However, it will be appreciated that such selection disks may also have a different profile from the one illustrated, to obtain other types of patterns on the fabric being knitted on the machine. The number of said disks 21 may, of course, be selected as desired to meet individual applicational requirements.

I claim:

1. A device for controlling needle selection particularly in a hose knitting machine of the type having at least one needle cylinder comprising:

a bank of selection slides selectively movable lengthwise;

a pattern drum having pegs arranged on a lateral surface thereof in accordance with knitting program;

rotating means comprising a ratchet pawl for imparting to said drum a stepwise rotating motion;

superimposed removable selection disks mounted for positive rotatory engagement on a rotating pin;

three-arms control levers each engaging with one arm one of said selection disks, the remaining two arms of each said control lever being respectively engaged with pegs of said pattern drum and with one of said selection slides;

a peripheral serration on said drum engaging said ratchet pawl;

a rocking lever having an oscillation axis and pivoting said ratchet pawl and configurated to follow a control cam;

a rotating cam having at least two profiles for cooperating with said rocking lever, said cam having a stationary axis of rotation arranged in parallel relation-ship with respect to the axis of the needle cylinder outside the periphery of said needle cylinder;

means for transmitting a rotation motion to the rotating cam about said stationary axis at a speed timed with the needle cylinder and a roller arranged between said rocking lever and said profiles, and carried on said rocking lever along an axis parallel to the oscillation axis of said rocking lever, means being provided for displacing axially said roller for alternate engagement with either of said profiles.

* * * * *